US005955847A

United States Patent [19]

Rothenbuhler

[11] Patent Number: 5,955,847

[45] Date of Patent: Sep. 21, 1999

[54] METHOD FOR DIMMING A FLUORESCENT LAMP

[75] Inventor: Dan E. Rothenbuhler, Meridian, Id.

[73] Assignee: Beacon Light Products, Inc., Meridian, Id.

[21] Appl. No.: 09/033,503

[22] Filed: Mar. 2, 1998

Related U.S. Application Data

[63] Continuation of application No. 08/406,183, Mar. 16, 1995, abandoned, which is a continuation-in-part of application No. 08/258,007, Jun. 10, 1994, Pat. No. 5,537,010.

[51] Int. Cl.[6] ..... H05B 37/02

[52] U.S. Cl. ..... 315/289; 315/DIG. 4; 315/DIG. 5

[58] Field of Search ..... 315/291, 289, 315/DIG. 4, DIG. 5

[56] References Cited

U.S. PATENT DOCUMENTS

| | | | |
|---|---|---|---|
| 3,265,930 | 8/1966 | Powell, Jr. . | |
| 3,321,338 | 5/1967 | Nuchols et al. . | |
| 3,422,309 | 1/1969 | Spira et al. | 315/DIG. 4 |
| 3,707,648 | 12/1972 | Rosa . | |
| 3,851,209 | 11/1974 | Murakami et al. . | |
| 3,919,590 | 11/1975 | Remery et al. . | |
| 3,925,705 | 12/1975 | Elms et al. . | |
| 3,927,345 | 12/1975 | Licata et al. | 315/DIG. 5 |
| 3,935,505 | 1/1976 | Spiteri . | |
| 3,942,070 | 3/1976 | Tomura et al. . | |
| 4,087,723 | 5/1978 | Chermin et al. . | |
| 4,099,099 | 7/1978 | Grüdelbach . | |
| 4,107,579 | 8/1978 | Bodine, Jr. et al. . | |
| 4,119,887 | 10/1978 | Iyama et al. . | |
| 4,165,475 | 8/1979 | Pegg et al. . | |
| 4,181,872 | 1/1980 | Chermin . | |
| 4,329,627 | 5/1982 | Holmes . | |
| 4,350,935 | 9/1982 | Spira et al. | 315/291 |

(List continued on next page.)

FOREIGN PATENT DOCUMENTS

| | | | |
|---|---|---|---|
| 46395 | 2/1982 | European Pat. Off. . | |
| 471331 | 8/1991 | European Pat. Off. | H05B 41/234 |
| 471215 | 2/1992 | European Pat. Off. . | |
| 471331 | 2/1992 | European Pat. Off. . | |
| 910 05 523 | 4/1991 | Germany . | |
| 2234868 | 2/1991 | United Kingdom | H05B 41/18 |
| 96/22007 | 7/1996 | WIPO . | |

OTHER PUBLICATIONS

Starlight TN22 Preliminary Data Sheet, *SGS–Thompson Microelectronics,* Nov. 1991, pp. 1/5–5/5.

*Primary Examiner*—Don Wong
*Assistant Examiner*—Tuyet Vo
*Attorney, Agent, or Firm*—John R. Ley

[57] ABSTRACT

The illumination intensity of a fluorescent lamp which has cathodes and an ionizable medium separating the cathodes is controlled by a method in which the lamp is ignited once during each half-cycle of applied AC current and is thereafter extinguished during that same half-cycle. The lamp is ignited by creating and applying an ignition voltage pulse of a magnitude greater than a characteristic operating voltage of the ionizable medium between the lamp cathodes. The lamp is extinguished by reducing the voltage between the cathodes to a value less than the operating voltage, at a point prior to a zero crossing of the applied AC current half-cycle in which the lamp was illuminated. Because the extinguishing point occurs prior to the end of the applied AC current half-cycle, the illumination intensity is reduced during each half cycle. The characteristics of the ignition pulse reliably ignite the lamp, thereby allowing extinguishing control on a half-cycle by half-cycle basis. The current which flows through the cathodes between the occurrence of the extinguishing point and the ignition point in each applied AC current half-cycle keeps the cathodes warm. The extinguishing point within each half-cycle of applied AC current is adjusted to vary the illumination intensity.

20 Claims, 5 Drawing Sheets

U.S. PATENT DOCUMENTS 4,355,264 10/1982 Merli ..... 315/289
4,447,759 5/1984 Moerkens et al. .
4,507,569 3/1985 Hess, II .
4,527,099 7/1985 Capewell et al. .
4,649,323 3/1987 Pearlman et al. .
4,651,060 3/1987 Clark .
4,673,844 6/1987 Maytum et al. .
4,733,138 3/1988 Pearlman et al. .
4,870,340 9/1989 Kral .
4,888,527 12/1989 Lindberg .
4,899,088 2/1990 Black, Jr. et al. .
5,004,960 4/1991 Cockram et al. .
5,010,274 4/1991 Phillips et al. .
5,030,890 7/1991 Johnson .
5,055,746 10/1991 Hu et al. .
5,111,115 5/1992 Ball et al. .
5,221,877 6/1993 Falk .
5,319,285 6/1994 Wang et al. .

METHOD FOR DIMMING A FLUORESCENT LAMP

CROSS REFERENCE TO RELATED APPLICATION

This is a continuation of application Ser. No. 08/406,183, filed Mar. 16, 1995, now abandoned, which is a continuation-in-part of U.S. patent application Ser. No. 08/258,007 for "Solid State Starter for Fluorescent Lamp" filed Jun. 10, 1994, and assigned to the Assignee hereof ("the '007 Application"), now U.S. Pat. No. 5,537,010. The '007 Application also relates to U.S. patent application Ser. No. 08/257,889 for "High Temperature, High Holding Current Semiconductor Thyristor" filed Jun. 10, 1994, now abandoned and assigned to the Assignee hereof.

This application is also related to the concurrently filed U.S. patent application for "Dimming Controller for a Fluorescent Lamp," Ser. No. 08/404,880, now U.S. Pat. No. 5,504,398, which is also assigned to the assignee hereof.

The information contained in all of the above identified applications is incorporated herein by this reference.

INTRODUCTION

This invention relates to a new and improved method for controlling the delivery of energy to a fluorescent lamp to achieve greatly improved control over the illumination intensity of the lamp. More particularly, the present invention relates to a new and improved method for controlling the illumination intensity of a fluorescent lamp by igniting and extinguishing the lamp in a selectively controllable manner during each half-cycle of applied AC power. More particularly st:ill, the present invention relates to extinguishing the illumination of the fluorescent lamp at a predetermined variable point during each AC half-cycle of applied power to control the illumination intensity.

BACKGROUND OF THE INVENTION

There are many desirable features associated with fluorescent lamps, compared to incandescent lamps. For example, fluorescent lamps typically use substantially less electrical power and produce equal or greater illumination. The lower power consumption is desirable to all users but is particularly important in those areas of the world with insufficient power generation capacity.

One of the difficulties associated with fluorescent lamps is starting or igniting them. Starting the lamp requires both a separate starter and the coalescence of various factors including the instantaneous voltage, timing and temperature, all of which have been discussed more completely in the '007 Application referenced above. The fluorescent starter described in the '007 Application is very effective in reliably igniting a fluorescent lamp and in eliminating many of the variables which have previously inhibited reliable starting.

One disadvantage associated with fluorescent lamps relates to controlling their illumination intensity. The typical fluorescent dimmer uses an electronic ballast which delivers a continuous current to the cathodes of the fluorescent lamp to maintain the cathodes in a heated condition during dimming. During normal operation, the current flowing between the cathodes in the fluorescent lamp is adequate to maintain the cathodes in an heated condition, thereby assuring reliable ignition with each half-cycle of applied AC power at full intensity operation. However, when the illumination intensity is reduced by reducing the voltage or current between the cathodes, the amount of cathode heating is reduced. If the cathodes are not heated sufficiently, the lamp will not reliably ignite with each half-cycle of applied AC power. Therefore, the electronic ballast must supply a separate cathode heating current while the voltage or current between the cathodes is varied to control the illumination intensity.

The necessity to control the heating current through the cathodes separately from the ignition or illumination voltage applied between the lamp cathodes has caused prior art dimmer controls and electronic ballasts to be relatively expensive and complex in construction. Furthermore, prior art fluorescent lamp dimmers are additional components used with the ordinarily lamp starters. Consequently, it is relatively costly to provide dimming capabilities for fluorescent lamps, and the added cost is one of the reasons that dimming controls for fluorescent lamps are not more widely used or accepted.

It is with respect to this and other background information that the present invention has evolved.

SUMMARY OF THE INVENTION

One of the important aspects of the present invention is the use of a relatively compact and inexpensive solid state control module, which functions to both start the lamp and dim its intensity in a relatively inexpensive and functionally effective manner. Another important aspect of the present invention is avoiding the necessity of using relatively costly dimmers for fluorescent lamps separate from the starter for the lamp. Still another important aspect of the present invention is providing a solid state starter, such as is described in the '007 Application, with the additional and highly advantageous function of controlling the illumination intensity of a fluorescent lamp at little or no additional cost. All of these important functional improvements are achieved without the necessity of separate dimmer controls and without compromising the very reliable starting performance achieved by the starter described in the '007 Application .

To accomplish these and other aspects, the present invention relates to a method of controlling the illumination intensity of a fluorescent lamp which has cathodes and an ionizable medium separating the cathodes. The lamp is energized by AC current and AC voltage applied in alternating half-cycles. The method includes the steps of igniting the lamp once each half-cycle of applied AC current by creating an ignition voltage pulse of a magnitude greater than an operating voltage of the ionizable medium and applying the ignition pulse to the lamp during each half-cycle of applied AC voltage when the in stantaneous applied AC voltage is also greater than the operating voltage. The method also includes the step of extinguishing the lamp during each half-cycle of applied AC current in which the lamp is ignited bay reducing the voltage between the cathodes to a value less than the operating voltage at a predetermined extinguishing point in the half-cycle of applied AC current. Lastly the method includes the step of establishing the extinguishing point to occur prior to a zero crossing of the applied AC current half-cycle in which the lamp was illuminated.

Because the extinguishing point occurs prior to the end of the applied AC current half-cycle, the illumination intensity is reduced during each half cycle. The characteristics of the ignition pulse reliably ignite the lamp, thereby allowing a reliable control over the intensity on a half-cycle by half-cycle basis even though the lamp is prematurely extinguished in each half-cycle. The current which flows through the cathodes between the times of occurrence of the extinguishing point and the ignition point in each applied AC current half-cycle keeps the cathodes warm without the use of separate current controllers. The igniting and extinguishing can be accomplished by use of the same relatively simple starting and dimming device.

Other preferred aspects of the method include steps which involve adjusting the extinguishing point within each half-cycle of applied AC current to control the illumination intensity, maintaining the voltage between the lamp cathodes below the operating voltage between the time of the extinguishing point and the creation of the ignition pulse, electrically connecting the lamp cathodes with a triggerable thyristor which exhibits a relatively high holding current characteristic, creating the ignition voltage pulse from a ballast by using the high holding current characteristic, adjusting the holding current of the thyristor to a relatively low level prior to triggering the thyristor at the extinguishing point and adjusting the holding current of the thyristor to a relatively high level after triggering the thyristor at the extinguishing point and before commutating the thyristor by the applied AC current achieving the relatively high level of the adjusted holding current.

A more complete appreciation of the present invention and its scope can be obtained by reference to the accompanying drawings, which are briefly summarized below, the following detailed description of presently preferred embodiments of the invention, and the appended claims.

DETAILED DESCRIPTION

Figure 1:
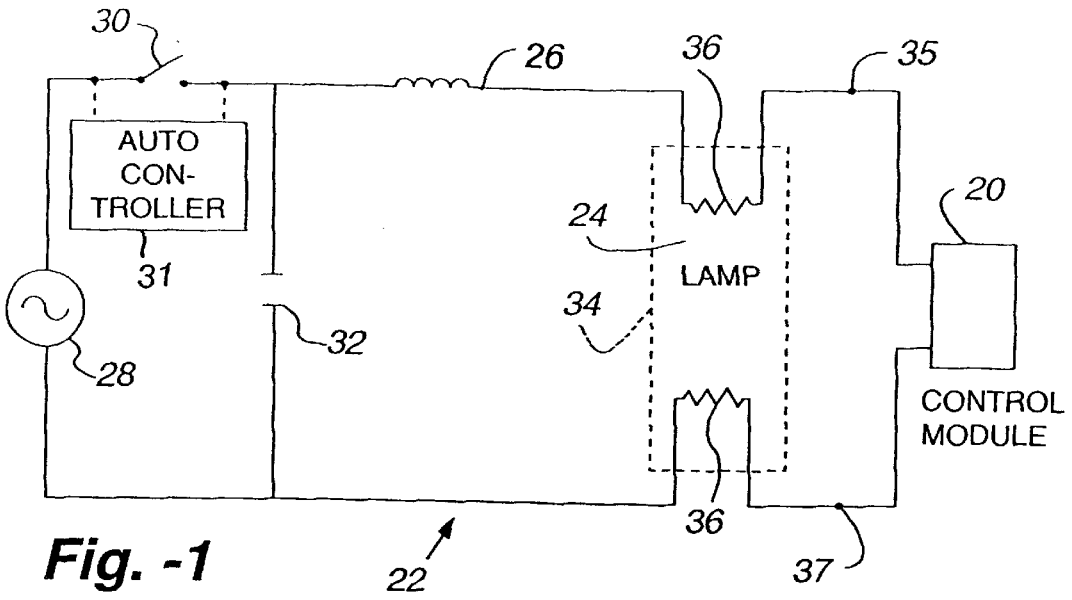
FIG. 1 is a simplified circuit diagram of a fluorescent lamp, a ballast, and an improved control module for controlling the intensity of the fluorescent lamp which incorporates the present invention, connected to a conventional AC power source and controlled by a manual switch.

The features of the present invention are preferably embodied in a control module 20 which is connected as a part of an otherwise-typical fluorescent lamp circuit 22 shown in FIG. 1. A fluorescent lamp 24 is connected in series with a current limiting inductor 26 known as a ballast. Conventional alternating current (AC) power from a source 28 is applied to the series connected lamp 24 and ballast 26 through a power control switch 30, or alternatively through an automatic controller 31. Typically the switch 30 will be a wall-mounted on/off power switch. The automatic controller 31 will replace the switch and perform the on/off power control functions as well as dimming control functions, as described below. A capacitor 32 is optional and may be connected in parallel with the series connected ballast 26 and the fluorescent lamp 24 to establish a more favorable power factor.

The fluorescent lamp 24 is formed generally of an evacuated translucent housing 34 which has two filament electrodes known as cathodes 36 located at opposite ends of the housing 34. A small amount of mercury is contained within the evacuated housing 34. With the lamp 24 lighted, the mercury is vaporized and ionized into a conductive medium, and current is conducted between the cathodes 36 through the mercury medium creating a plasma. The light energy from the plasma creates the illumination. Due to the conductivity characteristics of the plasma medium, the ballast 26 is necessary to limit the current flow through the plasma to prevent the cathodes 36 from burning out.

The control module 20 is connected in series with and between the cathodes 36 at terminals 35 and 37. The control module 20 includes functional elements similar to those described in the '007 Application as well as those described below. To light the lamp 24, the control module 20 establishes a closed series circuit between the cathodes 36 for a warm-up time period during which AC current from the source 28 flows through both cathodes 36 thereby heating the cathodes. The heat from the cathodes 36 helps vaporize the mercury within the housing 34. The heated cathodes 36 also emit low work energy ions from a barium coating on the surface of the cathodes to further assist in establishing the ionized medium within the housing 34.

After the warm-up time period, the control module ignites or starts the lamp 24 during a relatively short ignition time period. The unique characteristics of a thyristor preferably contained in the control module (described completely in the '007 Application) cause an almost instantaneous termination of the current flow through the control module 20 when the AC current is at a significantly high value, resulting in a relatively high change in current in a relatively short amount of time (di/dt). The ballast 26 responds to the relatively high di/dt by producing a very high voltage ignition pulse 134 (FIG. 6) which appears across the cathodes 36 and the non-conductive control module 20. The voltage of the ignition pulse is sufficiently high to break down the partially ionized mercury vapor within the lamp housing 34, causing a plasma arc to extend directly between the cathodes 36. The plasma arc extends directly between the cathodes 36 because the control module 20 is non-conductive and no longer presents a current path between the cathodes 36. The current between the cathodes more completely ionizes the mercury medium in the housing 34. The energized plasma creates the illumination.

Figure 2A:
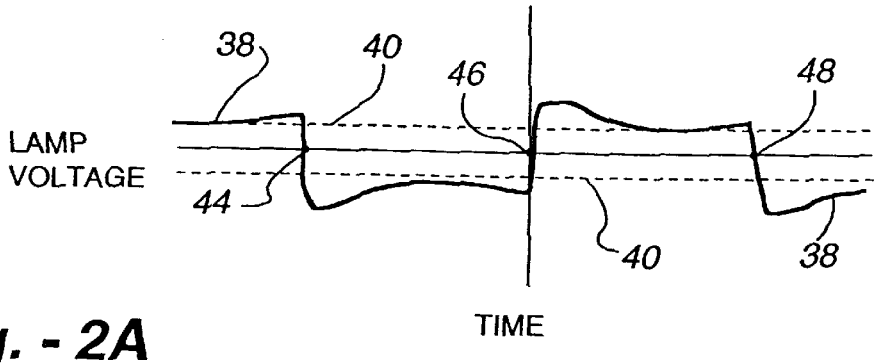
FIGS. 2A and 2B are waveform diagrams on a common time axis of the voltage appearing across the fluorescent lamp and the current conducted through the ballast, respectively, when the control module shown in FIG. 1 operates the fluorescent lamp at full intensity.

The instantaneous voltage which appears across the cathodes 36 when the plasma is ignited is represented by curve 38 shown in FIG. 2A. The characteristic operating voltage established by the ionized medium within the lamp is represented by the curve 40 shown in FIG. 2A. Notice that the instantaneous voltage 38 generally parallels the characterics operating voltage 40. The current which flows through the ionized and ignited mercury plasma also flows through the cathodes 36. The current continues to heat the cathodes and maintain the cathodes at a temperature adequate for continued operation. The heating assures that the lamp will ignite on a reliable basis between sequential half-cycles of power applied from the source 28. The current which flows through the ballast 26 and the lamp 24 under these conditions is shown in FIG. 2B by curve 42.

Figure 2B:
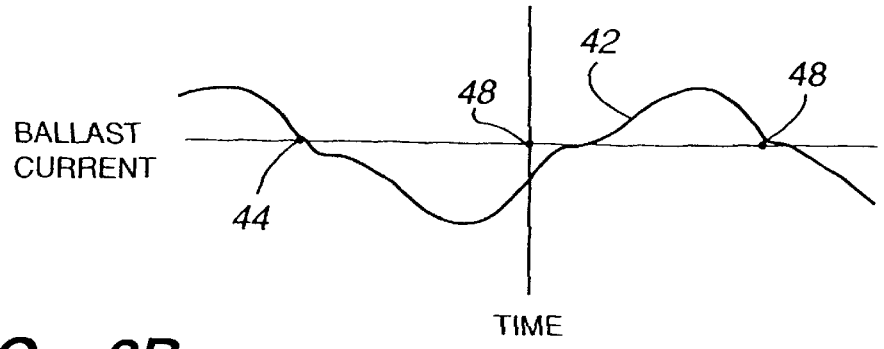

Points 44, 46 and 48 shown in FIGS. 2A and 2B represent the points where the AC voltage across the lamp 24 normally crosses the zero reference point represented by the horizontal axis in FIGS. 2A and 2B. The points 44, 46 and 48 thus represent the beginning and end of two consecutive half-cycles of applied AC voltage. The full illumination condition represented in FIG. 2A illustrates that the plasma is excited to the characterics operating voltage 40 over almost the whole duration of each half-cycle, except for the relatively slight time intervals at the beginning and end of each half-cycle.

The illumination intensity of the fluorescent lamp 24 is directly related to the product of the voltage waveform 38 shown in FIG. 2A and the current waveform 42 shown in FIG. 2B. For general comparative purposes, the illumination intensity is comparable in a proportionate sense to the area between the curve 38 and the horizontal axis in FIG. 2A. This comparative relationship will serve as a baseline by which to illustrate the degree of illumination intensity or brightness control achieved under the illumination intensity controlling conditions established by the present invention.

The control module 20 controls the illumination intensity of the fluorescent lamp 24 by reducing or dimming the amount of illumination emitted during each half-cycle of applied AC power. The control module does not create a dimming effect when the lamp is operated at maximum intensity.

The dimming effect is achieved as a result of the control module 20 becoming conductive at a predetermined time or point during each half-cycle of AC power applied from the source 28 across the cathodes 36. With the control module 20 in a conductive condition, the cathodes 36 are effectively connected together in series to short out the current path through the ionized mercury plasma between the cathodes. In this shorted-out condition, the current flowing through the plasma immediately ceases and the illumination from the lamp is extinguished for the remaining portion of that half-cycle of applied AC power. After the zero crossing point of the applied AC voltage waveform (points 44, 46 or 48), the control module 20 again ignites or starts the lamp as is described in the '007 Application. At the predetermined point in that half-cycle, the control module again connects the cathodes together to extinguish the lamp.

Extinguishing the lamp during each half-cycle reduces the average intensity of the lamp on an integrated continual basis. The on and off nature of the illumination from the lamp is not readily perceived by a human. The typical phosphor coating on the translucent housing creates a visual persistive effect to integrate the bursts of illumination. Furthermore, the bursts of illumination occur at a high enough frequency (120 Hz for a conventional 60 Hz applied power or 100 Hz for conventional 50 Hz applied power) that the human eye does not readily distinguish the flashes. As a result the illumination control is perceived as a smooth continuum of intensity levels over the operative dimming range of the control module.

Figure 3A:
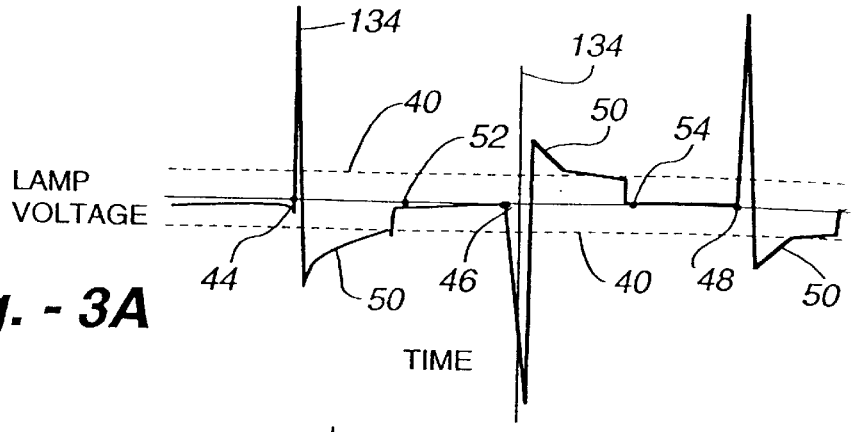
FIGS. 3A and 3B are waveform diagrams on a common time axis of the voltage appearing across the fluorescent lamp and the current conducted through the ballast, respectively, when the control module shown in FIG. 1 dims the fluorescent lamp to a power level which is approximately 50% of full intensity.

The dimming or illumination intensity control effect achieved by the control module 20 is illustrated by FIGS. 3A and 3B and FIGS. 4A and 4B compared to FIGS. 2A and 2B. As shown in FIG. 3A, the voltage represented by the curve 50 is applied across the cathodes 36 (FIG. 1) under one exemplary dimming condition. However at point 52, after the start at point 44 of one half-cycle of applied AC voltage, the control module 20 (FIG. 1) becomes conductive, causing the voltage of curve 50 to diminish to near zero at point 52. Point 52 occurs earlier in time before the applied AC voltage reaches the next zero crossing point 46. With the beginning of the next half-cycle of applied AC power at point 46, the lamp is again ignited and thereafter extinguished at point 54, prior to the end of that half-cycle at point 48. The process repeats in this manner, with the control module establishing the extinguishing points prior to the end of each half-cycle of applied power.

The predetermined point during each half-cycle of applied power where the lamp is extinguished determines the amount of light produced or the intensity of the lamp, as perceived by the human eye. This predetermined point is also referred to herein as the "firing angle," which describes the conduction point in terms of degrees or angle within each 180 degree half-cycle.

Figure 3B:
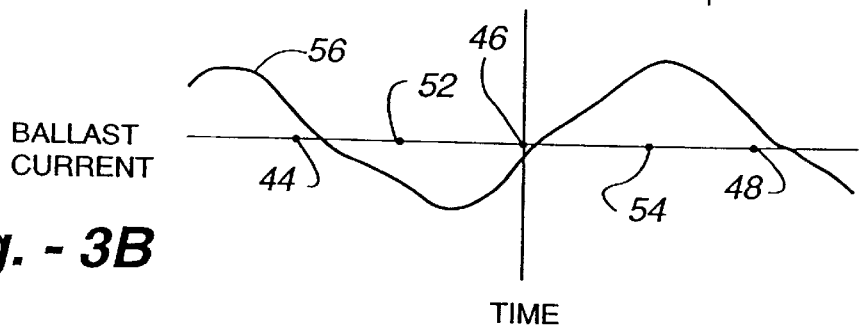

Curve 56 shown in FIG. 3B represents the current through the ballast 26 (FIG. 1) under the conditions represented in FIG. 3A. By comparing the curve 56 in FIG. 3B with the curve 42 in FIG. 2B, it can be seen that the inductive characteristics of the ballast do not result in large changes in the current flowing through the circuit 22 (FIG. 1) in the two conditions represented in FIG. 2A or FIG. 3A. Since the current flow remains similar in both cases, the power or illumination from the lamp is generally related to the voltage across the lamp as shown in FIG. 2A and 3A. Comparing FIG. 3A with FIG. 2A, it is apparent that the area between the curve 50 and the horizontal reference axis is considerably smaller than the area between curve 38 and the horizontal axis. For example, curve 50 may represent a fifty percent dimming factor in relation to the full intensity curve 38.

Figure 4A:
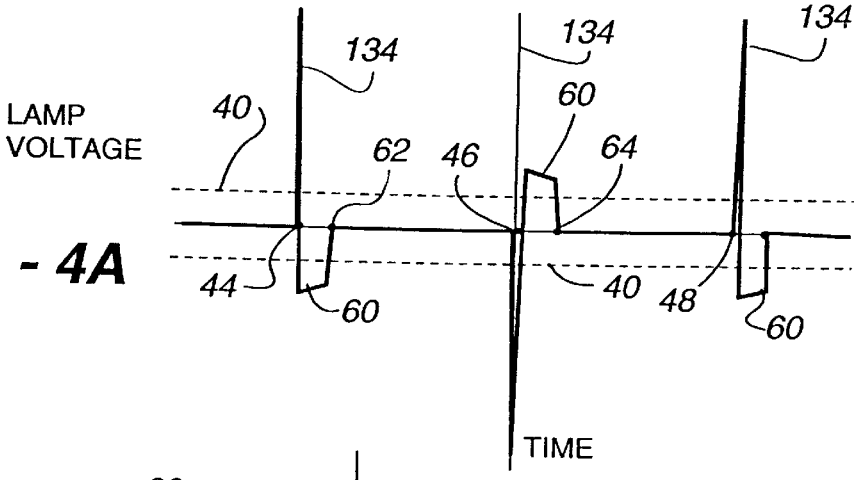
FIGS. 4A and 4B are voltage and current waveforms similar to those shown in FIGS. 3A and 3B respectively, when the control module shown in FIG. 1 dims the fluorescent lamp to a power level which is approximately 10% of full intensity.
Figure 4B:
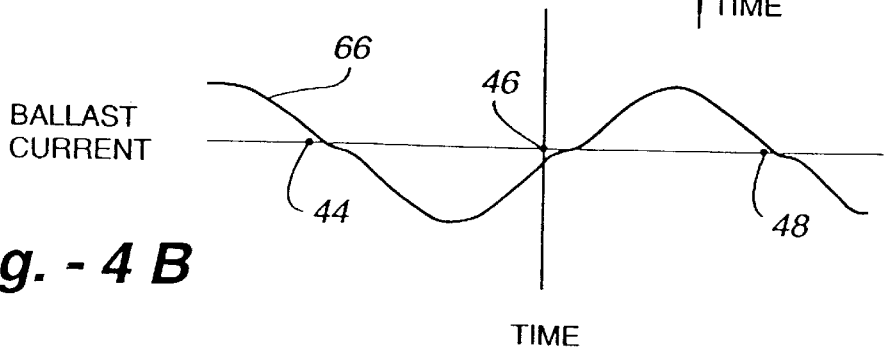

In a similar manner, FIGS. 4A and 4B represent the voltage and current conditions under an even further reduction in illumination, compared to those conditions shown in FIGS. 3A and 3B. The voltage represented by curve 60 is applied across the cathodes 36 (FIG. 1), but at point 62, after the start point 44 of the half-cycle, the control module 20 (FIG. 1) begins to conduct, causing the voltage of curve 60 to diminish to zero. Point 62 occurs earlier in time before the next zero crossing point 46 of that half-cycle and earlier in time than point 52 as shown in FIG. 3A. The control module accomplishes a similar igniting effect at the beginning of the next half-cycle at point 46, and similarly extinguishes the lamp at point 64 prior to the end of that half-cycle at point 48.

Curve 66 shown in FIG. 4B represents the current through the ballast under the conditions represented in FIG. 4A, and again the curve 66 shows that the inductive characteristics of the ballast 26 (FIG. 1) do not result in large changes in the current flow compared to the current flow under the conditions shown in FIG. 2B or FIG. 3B. Since the current flow remains similar, the power or illumination from the lamp is generally related to the voltage across the lamp as shown in FIGS. 2A, 3A and 4A. Comparing FIG. 4A with FIGS. 2A and 3A., it is apparent that the area between the curve 60 and the horizontal reference axis is considerably smaller than the area between curve 50 (FIG. 3A) and curve 38 (FIG. 2A) and their horizontal axes, meaning that the illumination intensity is further reduced in the condition shown by FIGS. 3A and 3B. For example, curve 60 may represent ninety percent dimming in relation to the full intensity curve 38. A range of full intensity to approximately a ninety percent reduction in full intensity is the effective operating range of illumination control achieved by the present invention.

Because the current curves 42, 56 and 66 are not significantly changed compared to the more significant changes in the voltage curves 38, 50 and 60, the power factor of the energy consumed in the circuit 22 (FIG. 1) varies considerably with the illumination intensity. In effect the load from the fluorescent circuit appears more inductive as the amount of dimming increases or the illumination intensity decreases. For this reason, it may be desirable to include the capacitor 32 (FIG. 1) in the circuit 22 to offset or correct the power factor.

The control module 20 includes many of the components from the solid state starter described in the '007 Application, including a high holding current thyristor 70, triac, or other type of semiconductor current switching device having the operational characteristics described herein and in the above referenced application Ser. No. 08/257,889. When the thyristor 70 conducts, the cathodes 36 (FIG. 1) are electrically connected in series. A microcontroller 72, or other logic circuit or state machine, controls the conduction of the thyristor 70, in accordance with information which has been preprogrammed into it.

Control signals supply input information to the microcontroller 72. The control signals are preferably in the form of short power interruptions which the user supplies by operating the power switch 30 (FIG. 1) or which the automatic controller 31 delivers under the control of the user. The power interruption control signals are applied to the microcontroller 72 over the interconnecting power lines. The microcontroller detects the power interruptions as power interrupt detections (PIDs). The microcontroller decodes the sequences, patterns and time durations of PIDs as control information. The control information communicated by the PIDs allows the user to completely turn off the lamp, to turn on the lamp, and to increase and decrease the intensity of illumination from the lamp, among other things. U.S. Pat. No. Re. 5,030,890 more completely describes this control feature in connection with an incandescent lamp. The control achieved by using PIDs to communicate control information is applicable to fluorescent lamps as a part of the present invention.

Figure 5:
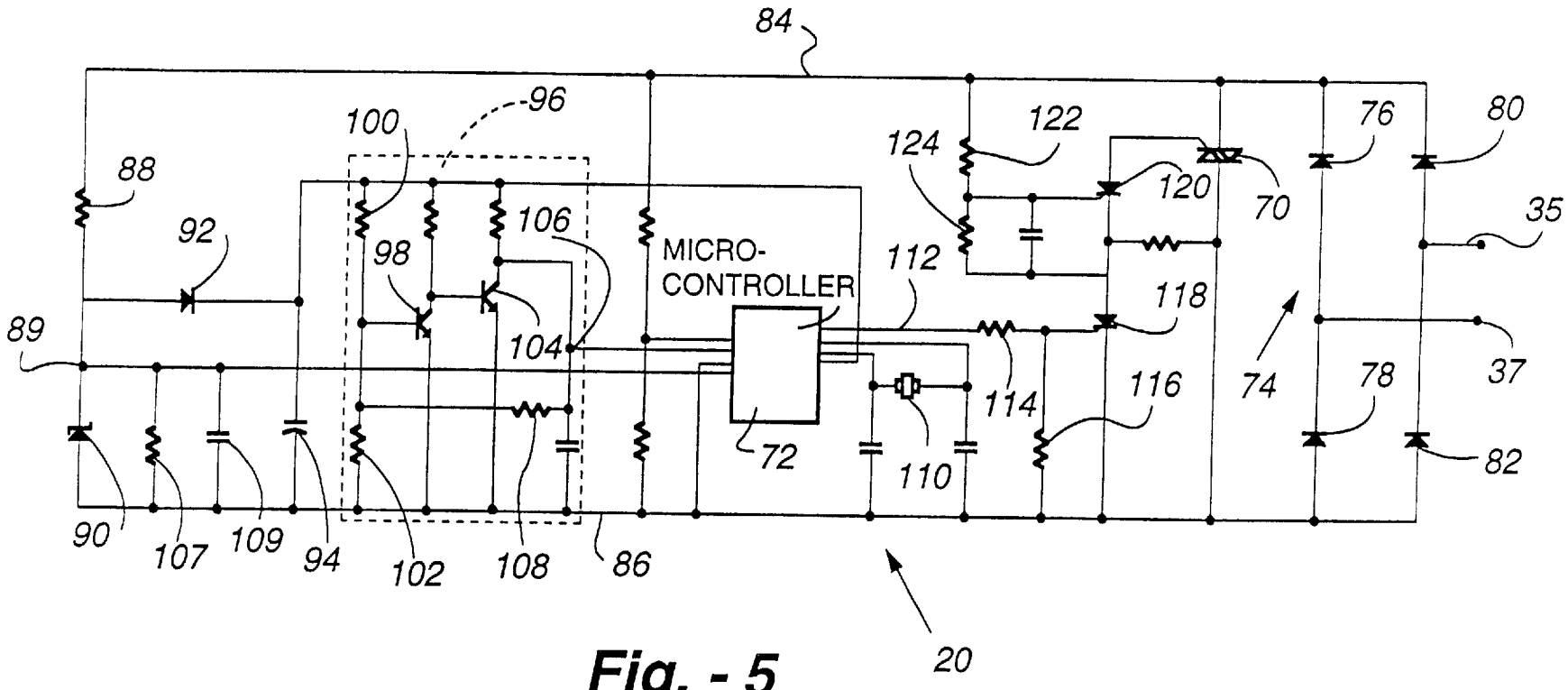
FIG. 5 is a schematic and block diagram of the control module shown in FIG. 1.

Details of the control module 20 are shown in FIG. 5. The control module 20 includes a full wave rectifying bridge 74 formed by diodes 76, 78, 8O and 82. The bridge 74 rectifies both the positive and negative half-cycles of applied AC power and applies positive potential at node 84 and negative potential at node 86. The thyristor 70 is connected between the nodes 84 and 86, and as such, the conduction of the thyristor will create the desired effect during both the positive and negative half-cycles of the AC power applied on the cathodes of the fluorescent lamp.

DC power for the microcontroller 72 is supplied by a power supply which is formed by a resistor 88 connected to the diode bridge 74, a voltage-regulating Zener diode 90, a blocking diode 92 and a storage capacitor 94. The storage capacitor 94 charges through the diode 92 to approximately the breakdown level of the Zener diode 90. The Zener diode establishes the voltage level of the power supply. During power interruptions and zero crossings of the applied AC voltage, the blocking diode 92 prevents the storage capacitor 94 from discharging. The storage capacitor 94 holds sufficient charge to maintain the microcontroller in a powered-up operative condition during the PIDs and during the times of zero crossings of the applied AC power.

A reset circuit 96 is connected to the storage capacitor 94 for the purpose of disabling the microcontroller 72 and resetting the microcontroller. The microcontroller is disabled until the power supply voltage across the storage capacitor 94 reaches the proper level to sustain reliable operation of the microcontroller 72. The microcontroller is reset when the power supply voltage across the storage capacitor 94 drops below that level which sustain reliable operation of the microcontroller.

The reset circuit 96 includes a transistor 98 which has its base terminal connected to a voltage divider formed by resistors 100 and 102. Until the power supply voltage across the storage capacitor 94 reaches a desired level, the voltage across the resistor 102 keeps the transistor biased into a non-conductive condition. When transistor 98 is non-conductive, a transistor 104 is also conductive, since the base of transistor 104 is forward biased by essentially any level of voltage from The power supply greater than its forward bias voltage. With the transistor 104 forward biased, the voltage at node 106 is low. A reset terminal of the microcontroller 72 is connected to the node 106, and while the voltage at the reset terminal is low, the microcontroller 72 is held in a reset or non-conductive state.

As the voltage across the power supply storage capacitor 94 increases, the voltage on the base of transistor 98 increases and eventually reaches the point where the transistor 98 starts to conduct. The conducting transistor 98 decreases the voltage at the base of transistor 104, causing transistor 104 to reduce its conduction. The voltage at node 106 starts to rise, and this increasing voltage is applied by a feedback resistor 108 to the base of transistor 98. The signal from the resistor 108 is essentially a positive feedback signal to accentuate the effect of the increasing conductivity of the transistor 98. The positive feedback causes an almost instantaneous change in the conductivity characteristics of the transistors 98 and 104, resulting in an almost instantaneous jump in the voltage level at node 106. Consequently, the reset signal rapidly and cleanly transitions between a low and high level to establish an operation condition for the microcontroller. A similarly acting but opposite situation occurs to establish a reset condition when the voltage from the power supply capacitor 94 diminishes below the operating level due to the positive feedback obtained from the resistor 108.

A filter is formed by a resistor 107 and a capacitor 109, and this filter is connected across the Zener diode 90 between a node 89 and the node 86. The microcontroller 72 includes an input terminal connected to the node 89 for the purpose of detecting zero crossings of the applied AC voltage signal. The resistor 107 and capacitor 109 eliminate any spurious signal effects which would otherwise inhibit the detection of the zero crossing event.

A regulated frequency reference for the clock frequency of the microcontroller 72 is established by a crystal 110 connected to two of the terminals of the microcontroller 72.

A signal for firing or triggering the thyristor 70 into a conductive condition is generated by the microcontroller at 112. The signal 112 is conducted through resistors 114 and 116 and the signal developed across resistor 116 is applied to the gate of a first pilot silicon controlled rectifier (SCR) 118. A second pilot SCR 120 is connected in series with the first SCR 118, and the series connection of the two pilot SCRs 118 and 120 extends between the gate of the thyristor 70 and the node 86. The conduction of SCR 118 causes a voltage to develop across the series connected resistors 122 and 124, because resistor 124 becomes connected through the conducting SCR 118 to the node 86. The voltage developed across the resistor 124 triggers the gate of the thyristor 120 and triggers it into conduction. The conductivity of both SCRs 118 and 120 draws gate current from the thyristor 70, triggering it into conduction. As a practical matter, the conductivity effects of the two pilot SCRs occurs so quickly that both become conductive essentially simultaneously with the thyristor 70.

Two pilot SCRs 118 and 120 are used to obtain a greater breakdown voltage. A high breakdown voltage is important to withstand the high voltage ignition pulses which occur during starting of the fluorescent lamp. A single pilot device could be employed in place of the two pilot SCRs 118 and 120 if the single device had a sufficiently high breakdown voltage. Furthermore, the two pilot SCRs 118 and 120, or a single SCR with a high breakdown voltage, could be fabricated on the same substrate as the thyristor 70, thereby achieving a single semiconductor device which accomplishes the functions of the discrete devices 70, 118 and 120, as shown in FIG. 5.

The thyristor 70 has a relatively high holding current, as explained in the '007 Application. Briefly, the holding current is that amount of current which the thyristor must conduct through its power terminals to maintain its conductive condition after it has been triggered. If the current falls below the holding current for any reason, the thyristor will immediately cease conduction or commutate.

The high holding current of the thyristor is advantageous characteristic used to reliably start or ignite the fluorescent lamp, as described in detail in the '007 Application. The role of the holding current in establishing the ignition pulses is summarized briefly here, in order to understand the interaction of the starting aspects and dimming aspects of the control module.

Figure 6:
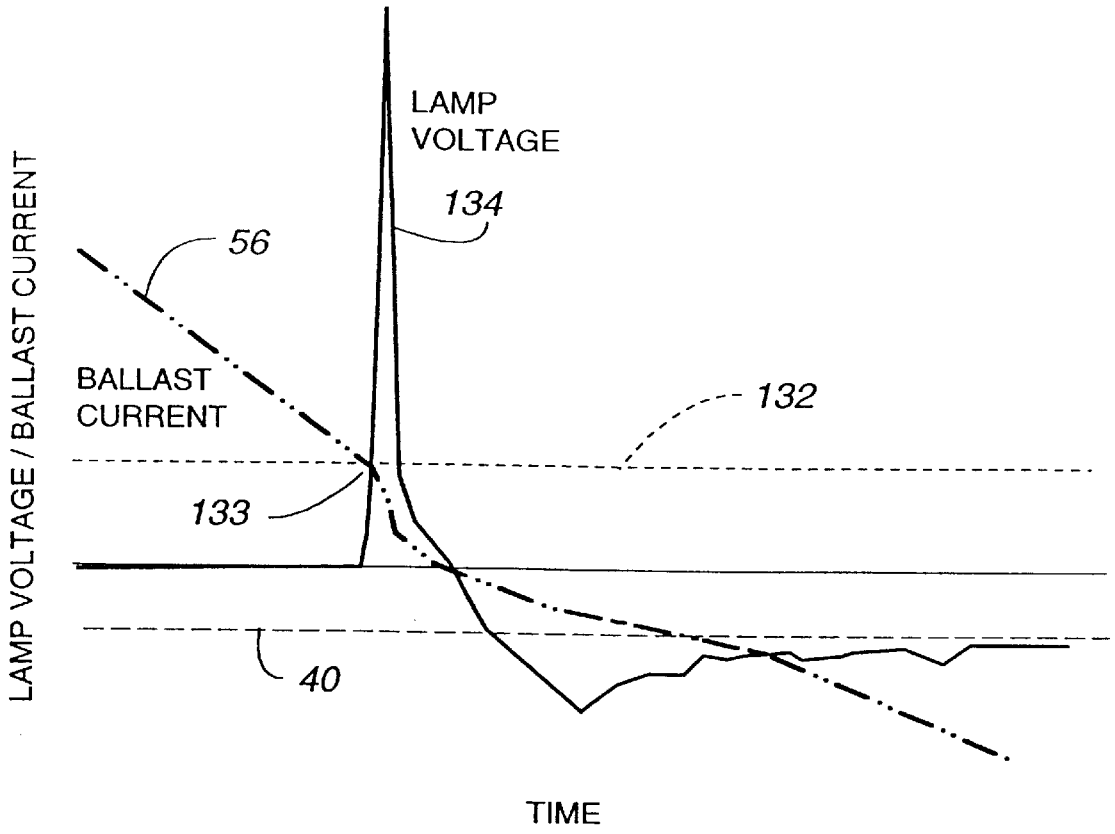
FIG. 6 is an enlarged waveform diagram which combines portions of the voltage and current waveforms shown in FIGS. 3A and 3B on a single axis to better illustrate the timing of a high voltage ignition pulse in relation to the current waveform and relative to the current holding level of a semiconductor thyristor.

When the current conducted by thyristor 70 approaches zero near the end of the half-cycle of current conduction shown in FIGS. 2B, 3B and 4B, the holding current level of the thyristor 70 is reached. FIG. 6 shows at 56 the current conducted during the end of the half-cycle illustrated in FIG. 3B, and the holding current level is shown at 132. As soon as the conducted current 56 reaches the holding current level 132, which occurs at point 133, the thyristor 70 ceases conducting and commutates off. At this commutation point 133, the current flowing through the ballast 26 (FIG. 1) is equal to the holding current 132. Due to the relatively high holding current level 132, the commutation of the thyristor 70 creates a relatively large change in current per change in time (di/dt). The inductive character of the ballast 26 responds to the high di/dt and causes a large voltage spike or pulse 134 to occur, as shown in FIG. 6. The pulse 134 is applied across the cathodes 36 (FIG. 1) of the lamp 24, and the pulse 134 is sufficiently large to ignite the plasma and light the lamp. By way of example, an ignition voltage pulse 134 of magnitude of 800 volts will occur for about 10 microseconds from a typical fluorescent ballast when the thyristor has a holding current of about 100 milliamperes.

The inductance of the ballast causes an approximate 90° phase shift between the AC current flowing through the ballast and the AC voltage across the cathodes. This phase shift ensures that the ignition voltage pulse 134 occurs at a time when the AC voltage across the lamp cathodes 36 (FIG. 1) is near the peak value of the phase shifted half-cycle of applied AC voltage. At this point the applied AC voltage exceeds the characteristic operating voltage 40 of the fluorescent lamp. Consequently, the high voltage ignition pulse 134 occurs when the pulse and applied voltage conditions are the most likely to start the fluorescent lamp. Very high reliability in igniting the lamp is achieved. It is due to this high ignition reliability that it is possible to achieve dimming or intensity control.

Following ignition of the lamp, the microcontroller 72 delivers a trigger signal 112 to gate the thyristor 70 into a conductive condition and to extinguish the lamp at a predetermined point within that same voltage half-cycle. The predetermined point during the half-cycle at which the thyristor is gated on is commonly referred to as the "firing angle." The firing angle is selectable and variable as represented by the points 52 and 54 in FIG. 3A and the points 62 and 64 in FIG. 4A. The predetermined points 52, 54, 62 and 64 are measured with respect to the zero crossing point of the applied AC voltage. During steady state conditions the predetermined points do not change in time duration measured from the zero crossing point.

The predetermined firing angle points establish the level of intensity of the lamp. Since the lamp is lighted between the beginning of the applied AC half-cycle until the thyristor 70 is fired into the conductive state at the extinguishing point, the amount of illumination from the lamp is represented by the conduction time between the beginning of the applied half-cycle and the extinguishing or firing angle point. Maximum illumination occurs when the lamp remains conductive for entire half-cycle. Diminishing amounts of illumination occur when as the extinguishing point moves closer to the zero crossing point at the beginning of the half-cycle.

Because the thyristor 70 has been gated on to a conductive condition before the end of the applied AC half-cycle, it is in a conductive condition to be commutated off at 133 when the applied AC current 56 reaches the holding current level 132, as shown in FIG. 6. Gating the thyristor into a conductive state during the half-cycle to control the illumination intensity also ensures that an ignition pulse 134 will occur to ignite the lamp at the beginning of the following half-cycle. The predetermined point during each applied voltage half-cycle when the thyristor 70 is gated on may be varied by the user to provide for different dimming or illumination intensities of the fluorescent lamp.

During the time when the thyristor is conductive and the fluorescent lamp is extinguished, current is drawn through the lamp cathodes, as shown by the current waveforms in FIGS. 2B, 3B and 4B. This current advantageously heats the cathodes, thereby maintaining them in a state of readiness for the next high voltage ignition pulse 134. The heated cathodes ensure that the lamp will relight on the following half-cycle. Additionally, maintaining the cathode temperature during the periods when the lamp is extinguished tends to extend the life of the cathodes by preserving a barium coating typically placed on fluorescent lamp cathodes. The barium coating promotes electron emissions during operation of the lamp and tends to evaporate during normal or full intensity operation of a fluorescent lamp. However, the barium coating degrades much more quickly when the lamp is relighted with cooled cathodes. Thus, heating the cathodes while the lamp is extinguished both prolongs the life of the lamp and helps to ensure that the lamp will be successfully restarted on each voltage half-cycle.

In some fluorescent lamps, the cathode heating current which flows during maximum dimming conditions may be excessive, especially under conditions of prolonged operation at low illumination intensity levels. The excessive current may shorten the lamp life and blacken the ends of the fluorescent lamp.

Figure 7:
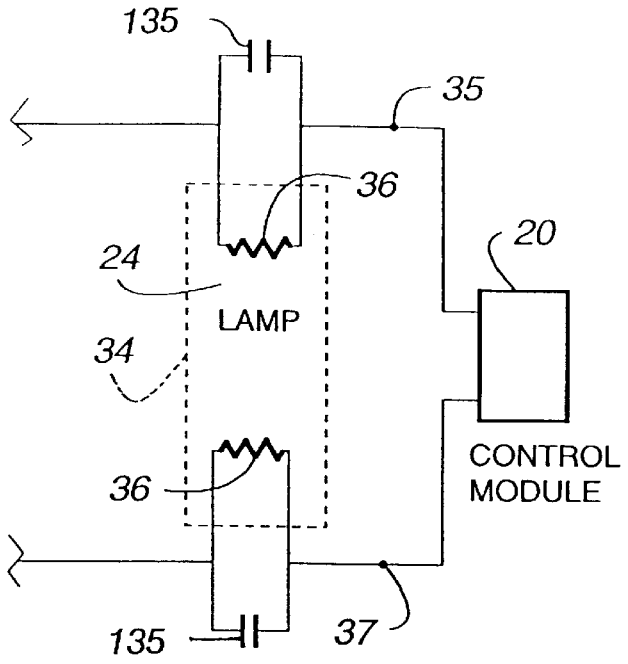
FIG. 7 is a circuit diagram of a portion of the circuit shown in FIG. 1, illustrating alternative circuitry.

The excessive cathode heating current may be eliminated by increasing the impedance of the cathodes or by diverting some of the current around the cathodes. Increasing the impedance of the cathodes requires the fluorescent lamp manufacturers to change their lamp manufacturing processes. However, connecting shunt capacitors 135 across each of the lamp cathodes 34, as shown in FIG. 7, effectively shunts excess current around the cathodes to avoid excess heating current problems if such problems should occur. Resistors (not shown) may also be used in place of the capacitors 135.

Since current is continuously drawn as an arc between the cathodes when the lamp is operating and through the control module and the lamp cathodes when the lamp is extinguished, the current waveforms shown in FIGS. 2B, 3B and 4B do not change appreciably as different levels of dimming are applied to the fluorescent lamp. However, the fluorescent lamp consumes less power when it is dimmed since the voltage duration during dimming (FIGS. 3A and 4A) is considerably less than the voltage duration across the cathodes when the fluorescent lamp is at full intensity (FIG. 2A).

Figure 8:
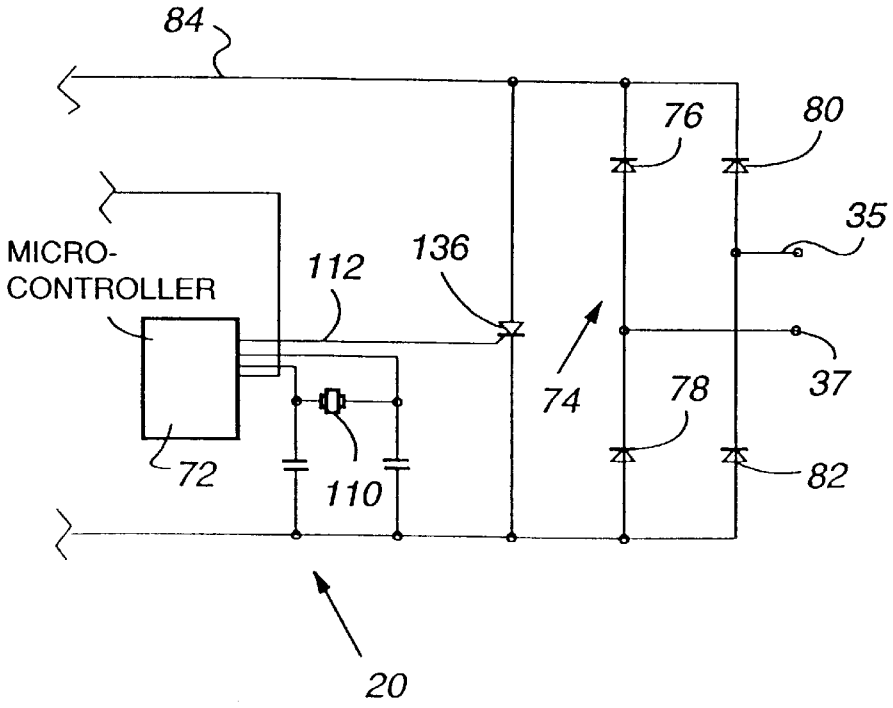
FIG. 8 is a circuit diagram of a portion of the circuit shown in FIG. 5, illustrating alternative circuitry.

An alternative to using the high holding current thyristor 70, is the use of a controllable holding current SCR 136 as shown in FIG. 8. The SCR 136 has the property of varying its holding current depending on the load connected to its gate. When the gate is at a high impedance, which occurs when the gate is not connected or open circuited, the holding current is relatively low. When the gate is at a low impedance, which occurs when the gate is connected to the cathode terminal of the SCR 136, the holding current of the SCR 136 is high. Because of this characteristic, use of the SCR 136 eliminates the need for the pilot SCRs 118 and 120 (FIG. 5) and their associated circuitry.

By triggering the SCR 136 and immediately thereafter opening the gate circuit, the SCR will remain in a conductive condition even though the current flow may be relatively low. In effect the triggering sensitivity is greatly increased by immediately opening the gate circuit after triggering. The increased sensitivity eliminates the need for the current amplifying effect of the pilot SCRs 118 and 120. On the other hand, reapplying the gate signal to the SCR 136 just before the applied AC current reaches the zero crossing point increases the value of the holding current to assure that a high di/dt will generate a high voltage ignition pulse. Thus the variable holding current effects of the SCR are useful in both creating a precise extinguishing point and in creating a high ignition pulse 134 (FIG. 6). The SCR 136 may be a device offered for sale by SGS Thomson as part number TN 22.

Controlling the intensity level of the fluorescent lamp 24 with the control module 20 is accomplished by input control signals delivered to the microcontroller. Preferably the input control signals are short power interruptions created by operation of the power switch 30 or the automatic controller 31 (FIG. 1). The power interruptions are sensed by the microcontroller as power interruption detections (PIDs). The sequence, pattern or duration of the PIDs is correlated to the programmed information in the microcontroller to control the operation of the control module 20, by causing the microcontroller to adjust the firing angle extinguishing point and establish the different illumination intensity levels in response to the PIDs.

The PIDs may be manually created, such as by flipping the switch 30 (FIG. 1). The manual creation of PIDs is recognized by the microcontroller and is sufficient to index or change the intensity to a predetermined number of programmed intensity levels established by the firmware or microcode in the microcontroller. This type of manual control is more completely explained in U.S. Pat. No. Re 35,220.

The control module 20 achieves a relatively high degree of control over the illumination intensity of a fluorescent lamp, at a relatively inexpensive cost compared to prior art fluorescent dimmers. The illumination intensity control is achieved by use of essentially the same components which form the fluorescent starter described in the aforementioned '007 Application, although the microcontroller is programmed to achieve the dimming capability. The present invention retains the greatly improved starting capabilities described in the '007 Application, but further adds the additional functionality of controlling the lamp intensity without using additional control elements, such as expensive electronic ballasts having voltage controllers and cathode warming current controllers, which are typically used in prior art fluorescent dimmers.

Because the control module 20 and thyristor 70 will quickly and reliably restart the lamp on each half-cycle, stable lamp illumination without perceptible flicker can be achieved with lamp-on times as short as 750 microseconds out of each 60 Hz half-cycle. Under these conditions dimming of approximately ninety percent can be easily achieved with fluorescent lamps. In cases where the specific timing and response characteristics of the circuitry is not a limiting factor, dimming to approximately ninety-nine percent of the maximum capacity has been achieved. The dimming capability available from the present invention is comparable to that achieved with incandescent lamps.

A presently preferred embodiment of the invention and its improvements have been described with a degree of particularity. This description has been made by way of preferred example. It should be understood that the scope of the present invention is defined by the following claims, and should not necessarily be limited by the detailed description of the preferred embodiment set forth above.

The invention claimed is:

1. A method of controlling an illumination intensity of a fluorescent lamp having cathodes energized by an AC current and an AC voltage applied in alternating half-cycles from an AC power source, each applied half-cycle of the AC current extending between zero crossing points, the fluorescent lamp connected in series with the AC power source and a ballast, said method comprising the steps of:

igniting the lamp once each half-cycle of applied an AC current conducted by the lamp cathodes, accomplishing said igniting by creating an ignition voltage pulse of a magnitude greater than a characteristic operating voltage of the lamp and applying the ignition pulse to the lamp at a time when an instantaneous applied AC voltage from the AC source is also greater than the characteristic operating voltage;

extinguishing the lamp during said each half-cycle of the applied AC current in which the lamp has been previously ignited, accomplishing said extinguishing by reducing the voltage between the cathodes to a value less than the characteristic operating voltage at a predetermined extinguishing time point in said each half-cycle of the applied AC current;

establishing an extinguishing time point to occur after the time when the ignition pulse is applied and prior to the zero crossing point at the end of said each applied AC current half-cycle in which the lamp was illuminated;

creating the ignition pulse through interacting the ballast with a decrease in the magnitude of the applied AC current conducted through the lamp cathodes after the extinguishing time point and at approximately the zero crossing point of the applied AC current half-cycle.

2. A method as defined in claim 1 further comprising the step of:

adjusting an occurrence of the extinguishing time point within said each half-cycle of the applied AC current to control the illumination intensity.

3. A method as defined in claim 2 further comprising the steps of:

controlling a range of the illumination intensity between ten percent of a maximum illumination intensity of the lamp and the maximum illumination intensity by adjusting the occurrence of the extinguishing time point within said each half-cycle of the applied AC current.

4. A method as defined in claim 1 further comprising the step of:

maintaining a voltage between the lamp cathodes below the characteristic operating voltage between the extinguishing time point and the time of applying the ignition pulse in a next subsequent applied AC current half-cycle.

5. A method as defined in claim 1 further comprising the steps of:

reducing the lamp voltage between the lamp cathodes below the characteristic operating voltage by electrically connecting the lamp cathodes together at the extinguishing time point.

6. A method as defined in claim 5 further comprising the step of:

electrically connecting together the lamp cathodes from the extinguishing time point in each applied AC current half-cycle until approximately an end of that applied AC current half-cycle.

7. A method as defined in claim 5 further comprising the steps of:

maintaining the lamp cathodes electrically connected together from the extinguishing point to approximately the end of the applied AC current half-cycle occurring after the extinguishing time point.

8. A method as defined in claim 5 further comprising the steps of:

electrically connecting together the lamp cathodes beginning at the extinguishing time point in said each applied AC current half-cycle; and maintaining the lamp cathodes electrically connected together until the time of applying a next subsequent ignition pulse.

9. A method as defined in claim 1 further comprising the steps of:

reducing the voltage between the lamp cathodes by electrically short circuiting the lamp cathodes at the extinguishing time point.

10. A method as defined in claim 9 further comprising the step of:

maintaining the electrical short circuit between the lamp cathodes between the time of the extinguishing point and the time of applying the ignition pulse.

11. A method as defined in claim 1 further comprising the steps of:

electrically connecting a triggerable thyristor between the lamp cathodes, the triggerable thyristor having a holding current;

reducing the lamp voltage between the lamp cathodes below the characteristic operating voltage by triggering the thyristor into conduction at the extinguishing time point; and maintaining the thyristor in conduction between the extinguishing time point and applying the ignition pulse.

12. A method as defined in claim 11 further comprising the step of:

commutating the thyristor into a non-conductive condition prior to the end of said each applied AC current half-cycle within which the thyristor was previously triggered when the applied AC current reaches the level of the holding current of the thyristor.

13. A method as defined in claim 12 further comprising the step of:

creating the ignition voltage pulse from the ballast by an effect of a change in current per change in time resulting from commutating the thyristor into a non-conductive condition.

14. A method as defined in claim 12 further comprising the step of:

adjusting the holding current of the thyristor to a relatively lower level within said each half-cycle of applied AC current prior to triggering the thyristor at the extinguishing time point; and adjusting the holding current of the thyristor to a relatively higher level after triggering the thyristor at the extinguishing time point and before commutating the thyristor.

15. A method as defined in claim 1 further comprising the steps of:

connecting a control module between the lamp cathodes; and performing the aforesaid functions of igniting and extinguishing the lamp with the control module.

16. A method as defined in claim 1 further comprising the step of:

heating the cathodes by conducting applied AC current through the cathodes during a portion of said each applied AC current half-cycle during which the lamp is ignited and extinguished.

17. A method as defined in claim 1 further comprising the step of:

heating the cathodes by conducting applied AC current through the cathodes between the extinguishing time point and approximately until the zero crossing point at the end of said each applied AC current half-cycle during which the lamp was ignited.

18. A method as defined in claim 17 further comprising the step of:

diverting some of the applied AC current around the cathodes while heating the cathodes.

19. A method as defined in claim 18 further comprising the step of:

connecting a capacitor to the cathodes to divert some of the applied AC current.

20. A method as defined in claim 18 further comprising the step of:

connecting a resistor to the cathodes to divert some of the applied AC current.

* * * * *